US005142708A

United States Patent [19]

Johnson et al.

[11] Patent Number: 5,142,708

[45] Date of Patent: Sep. 1, 1992

[54] FOOTFLUSH ADAPTER FOR URINALS

[76] Inventors: Michael J. Johnson; Rebecca K. Johnson, both of 519 S. Independence, Sapulpa, Okla. 74066

[21] Appl. No.: 666,003

[22] Filed: Mar. 7, 1991

[51] Int. Cl.[5] ..... E03D 5/08

[52] U.S. Cl. ..... 4/249; 4/308

[58] Field of Search ..... 4/249-250, 4/405

[56] References Cited

U.S. PATENT DOCUMENTS

| | | | |
|---|---|---|---|
| 718,971 | 1/1903 | Becker | 4/249 X |
| 1,226,716 | 5/1917 | Staszak | 4/405 X |
| 1,585,557 | 5/1926 | Miller | 4/249 |
| 1,614,346 | 1/1927 | Coret | 4/249 |
| 1,616,509 | 2/1927 | Rehn | 4/251 |
| 2,204,867 | 6/1940 | Rehback | 4/249 X |
| 2,467,019 | 4/1949 | Farson | 4/249 |
| 2,679,651 | 6/1954 | Pokorny | 4/249 X |
| 2,908,915 | 10/1959 | Holl | 4/249 |
| 3,045,248 | 7/1962 | Gentry | 4/249 X |
| 3,883,904 | 5/1975 | Wittman | 4/249 |
| 4,534,073 | 8/1985 | Smith | 4/251 |
| 4,612,954 | 9/1986 | Lissau | 4/308 |
| 5,056,165 | 10/1991 | Wescott | 4/249 |

*Primary Examiner*—Charles E. Phillips
*Attorney, Agent, or Firm*—Head & Johnson

[57] ABSTRACT

A footflush adapter permits flushing of a toilet having a bowl and a stool and a flush lever extending from a side wall of a bowl without manual contact therewith, including an adapter plate supported to the stool bowl, a tubular support member received by the adapter plate and vertically supported by it, a rod slidably and vertically supported in the tubular support member, a chain connecting the member upper end to the flush lever, and a horizontal foot member affixed to the rod lower end so that by the user's foot the flush lever is pivoted to flush the stool.

3 Claims, 4 Drawing Sheets

FOOTFLUSH ADAPTER FOR URINALS

SUMMARY OF THE INVENTION

Substantially all stools and urinals employed in public restrooms require manual flushing. Many people abhor contact with manual flush levers of stools and urinals, knowing that the same have been contacted by many hundreds of previous users. This disclosure provides adapters for use in converting normally manually operated stools and urinals so that they can be flushed without manual contact, and, specifically, so that they can be flushed by the foot of the user.

For reference to others who have provided foot operated flushing systems, see the following prior issued U.S. Pat. Nos. 2,467,019; 4,612,954; 1,614,346 and 1,226,716.

The present disclosure provides a foot flushing adapter for use with a common type toilet having a toilet bowl with a generally horizontal upper surface on which a toilet seat is supported, and a water closet is connected to the toilet bowl. The water closet has generally vertically sidewalls, one of which rotatably receives a shaft extending therethrough for use in flushing the toilet. Affixed to the shaft externally of the bowl is a flush lever. The toilet is flushed by manually depressing the lever, thereby rotating the shaft to actuate a flushing mechanism within the toilet bowl.

By the arrangement of this disclosure, an adapter plate is supported to the toilet bowl upper surface and extends generally horizontally therefrom and underneath the flush lever.

A tubular support member is vertically supported by the adapter plate.

A rod is slidably received in and vertically reciprocally supported in the tubular support member. A flexible connecting member, such as a chain, has one end connected to the upper end of the rod and the other end connected to the flush lever adjacent the outer end.

A generally horizontal foot member is affixed to the rod at the lower end thereof. The foot member is thereby supported adjacent to the toilet bowl so that downward displacement, such as by contact by the foot of the user, displaces the rod and the flexible member to thereby displace the flush lever, rotating the flush shaft to flush the toilet. In this manner, the normally manually flushed toilet having a bowl and a water closet can be flushed by foot if the user chooses. The possibility of manual flushing of the toilet is not changed.

In a preferred arrangement, a compression spring is received within an enlarged internal diameter portion of the tubular support member. The compression spring engages a collar affixed to the rod to resiliently urge the rod in the upward position, so that the rod is downwardly displaced by foot contact with the foot plate compressing the spring. Upon release of foot contact, the compression spring returns the rod to the upper position.

In another embodiment, the principles of this disclosure may be used to provide an adapter for foot flushing of the typical wall mounted urinal. A typical wall mounted urinal normally has positioned above it a flush valve with a flush lever extending generally horizontally therefrom. The urinal is usually flushed by manual displacement of the flush lever, pivoting it with relation to the flush valve. To adapt such a wall mounted urinal to flushing by foot rather than by hand, a post is supported uprightly on the floor below and adjacent the urinal. A foot actuator has an internal opening therein communicating with the actuator lower end. The foot actuator is telescopically received on the post. The lower end of the foot actuator is of increased external diameter providing a circumferential horizontal extending surface adapted to be contacted by the foot of the user.

A flexible connecting member, such as a chain, is connected between the upper end of the foot adapter and the flush valve lever. When the foot adapter is downwardly depressed by foot contact, the connecting member transfers downward displacement to the flush lever, pivoting it to thereby flush the urinal.

In some embodiments it is desirable that an extender member be affixed to the flush valve lever. The extender is affixed coaxially with the lever, and the outer end thereof is attached to the upper end of the flexible connecting member. The use of the extender member provides for increased leverage of the flush valve lever for more positive displacement thereof by foot contact with the foot actuator.

A better understanding of the invention will be had by reference to the following description and claims, taken in conjunction with the attached drawings.

DESCRIPTION OF THE PREFERRED EMBODIMENTS

Figure 2:
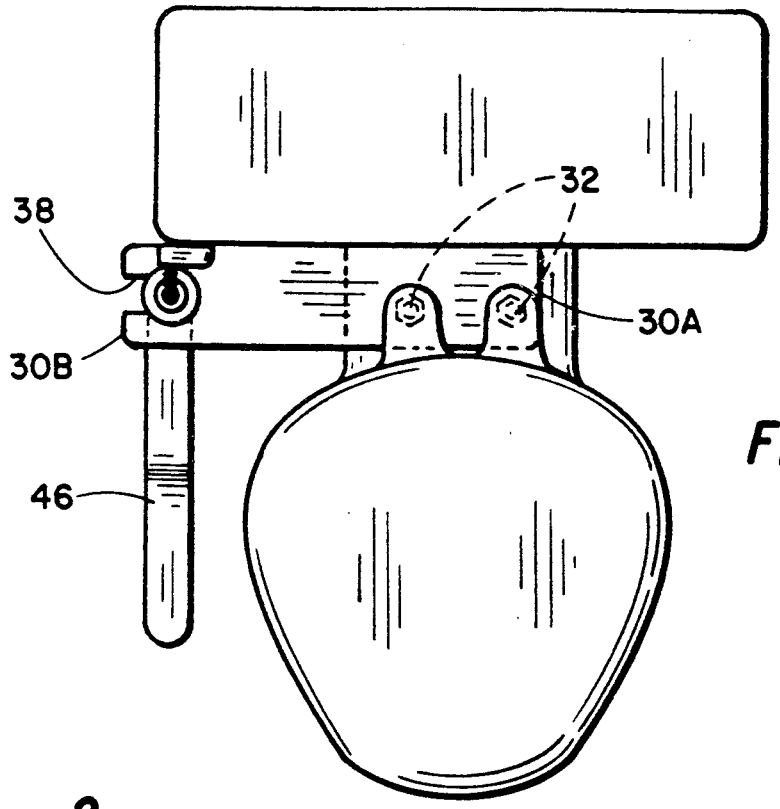
FIG. 2 is a top plan view of the toilet of FIG. 1, showing the adapter of this disclosure affixed to it.
Figure 1:
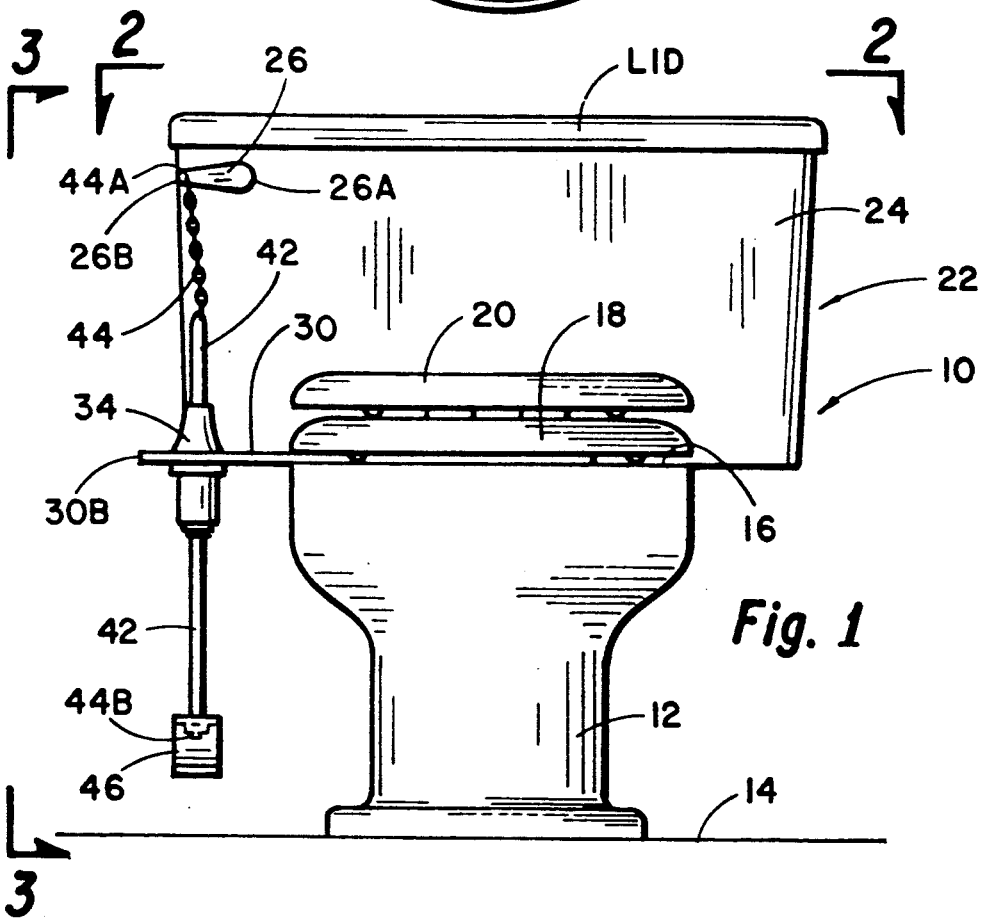
FIG. 1 is a front elevational view of a typical stool as used in public toilets and includes a stool portion and a water closet and showing the adapter of this disclosure affixed to the stool, adapting the toilet to foot flushing.
Figure 3:
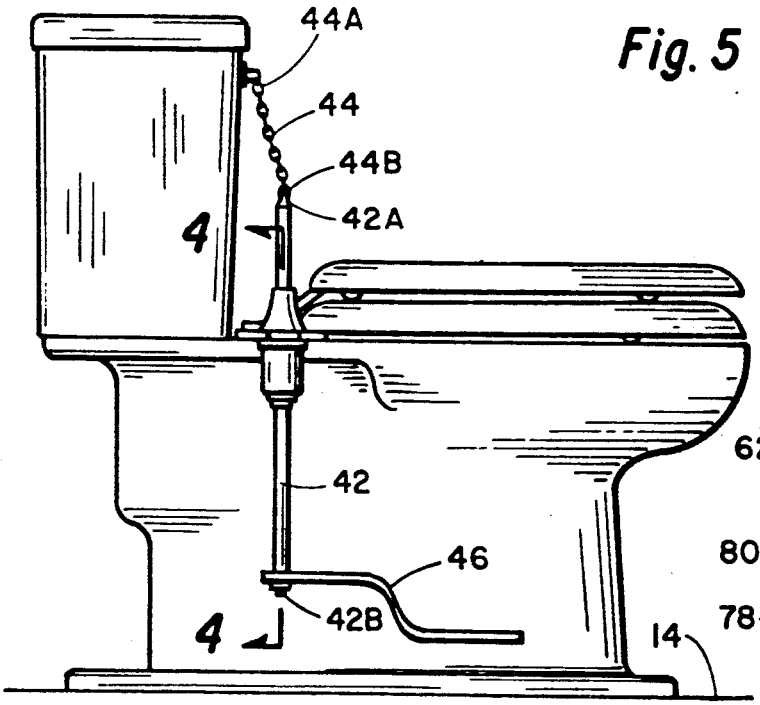
FIG. 3 is an elevational side view as taken along the line 3—3 of FIG. 1 and showing more details of the foot flush adapter.

Referring to the drawings and first to FIGS. 1, 2 and 3, a toilet of the type commonly employed in public facilities is illustrated. The toilet is generally indicated by the numeral 10 and includes a stool 12 which rests on floor 14. The stool has a generally horizontal upper surface 16. Usually a seat 18 is pivoted to the stool horizontal upper surface 16 and in most cases, in addition to the seat, a lid 20 is also pivoted to the stool.

Water closet 22 is supported on the stool 12 and provides a reservoir of water for use in flushing the stool. A water closet typically includes at least one generally vertical surface 24. Extending through an opening in the vertical surface 24 is a shaft (not shown), the outer end of which receives a flush lever 26. The toilet is flushed by rotatably displacing the flush lever 26. Lever 26 typically extends in a generally horizontal direction, as illustrated, and if it does not normally extend in such horizontal direction, a typical toilet has facilities so that by easy adjustment, the flush lever 26 can, in its non-actuated position, extend generally horizontally as shown. The flush lever has an inner end 26A which is affixed to a shaft (not shown) and an outer end 26B.

The toilet 10 described to this point is, as above-indicated, of the type generally used in public facilities, and the toilet is flushed by manual displacement of the flush lever 26. As previously described, many users do not like to manually touch portions of the toilet which have been touched by many prior users. The purpose of this disclosure is to provide a means of flushing a toilet, as described with reference to elements 10–28, without manual engagement with any part of the toilet.

Affixed to the stool upper horizontal surface 16 is an adapter plate 30 which may be supported by bolts 32, which are commonly used to pivotally support the seat 18 and the lid 20. The adapter plate has an inner end 30A and an outer end 30B.

Figure 4:
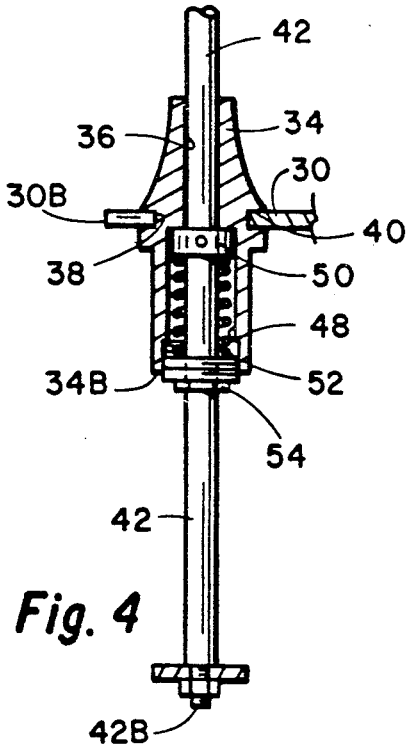
FIG. 4 is a fragmentary, slightly enlarged cross-sectional view of major portions of the foot flush adapter taken along the line 4—4 of FIG. 3.

Supported to the adapter plate outer end is a tubular support member 34. The member being tubular has, as shown in FIG. 4, an opening 36 therethrough. The tubular support member 34 may be secured to plate 30 in a variety of ways. In the way illustrated, the outer end of the tubular support member has a slot 38 therein, and the tubular member 34 has a circumferential slot 40. This circumferential slot or groove 40 is slidably and snugly received in the U-shape slot 38 of adapter plate 30 so that the tubular support member is easily assembled onto the plate and readily held by it.

Slidably received in the tubular opening 36 in the support member 34 is a rod 42 having an upper end 42A and a lower end 42B. Affixed to the rod upper end 42A is a flexible connecting member 44 which is illustrated as a chain, although obviously a cord may be used instead. Chain 44 has an upper end 44A and a lower end 44B. The lower end of chain 44B is affixed to the upper end 42A of rod 42. The upper end 44A of the chain is secured to the flush lever outer end 26B.

Secured to the lower end 44B of the rod is a foot lever 46. The foot lever extends generally horizontally from the rod end and may be formed of integral portions having different elevations above the floor 14, as illustrated in FIG. 3.

When the user desires to flush the toilet 10, he or she may do so by stepping on the foot lever 46. This downwardly slidably displaces rod 42, and by means of flexible connecting member or chain 44 rotates the flush lever 26 to flush the toilet in the same manner as if the flush lever had been manually rotatably displaced. Upon release of foot pressure on lever 46, rod 42 is free to be displaced upwardly, releasing rotation imparting force on the flush lever 26.

FIG. 4 discloses a preferred arrangement wherein upward bias is applied to rod 42. For this purpose, a portion of the tubular opening through the tubular support member 34 is of enlarged internal diameter, such portion being indicated by the numeral 48. Positioned on rod 42 within enlarged opening 48 is a collar 50. On rod 42 within opening 48 is a helical compression spring 52. Attached to the tubular support member lower end 34B is a closure member 54 having an opening therethrough which slidably receives rod 42. The closure member may be externally threaded to thereby engage internal threads in the lower end of the tubular support member 34.

By the arrangement of FIG. 3, when the rod 42 is downwardly displaced by foot engagement with lever 46, spring 52 is compressed. When foot pressure is relieved, spring 52, by engagement with collar 50, urges the rod 42 into its upward position. In this manner, the flexible connecting member or chain 44 can always be provided with slack in it when the rod is the upward, non-actuated position, to allow the flush lever 26 to automatically return to its normal position after a flushing operation.

The adapter, as described by the reference to the elements 30–54, is a relatively inexpensive device easily and quickly adapted to a typical toilet of the type illustrated, having a bowl 12 and a water closet 22 and easily facilities the use of such equipment without changing the water closet itself in any way. In this arrangement, the water closet is still subject to manual flushing.

Figure 5:
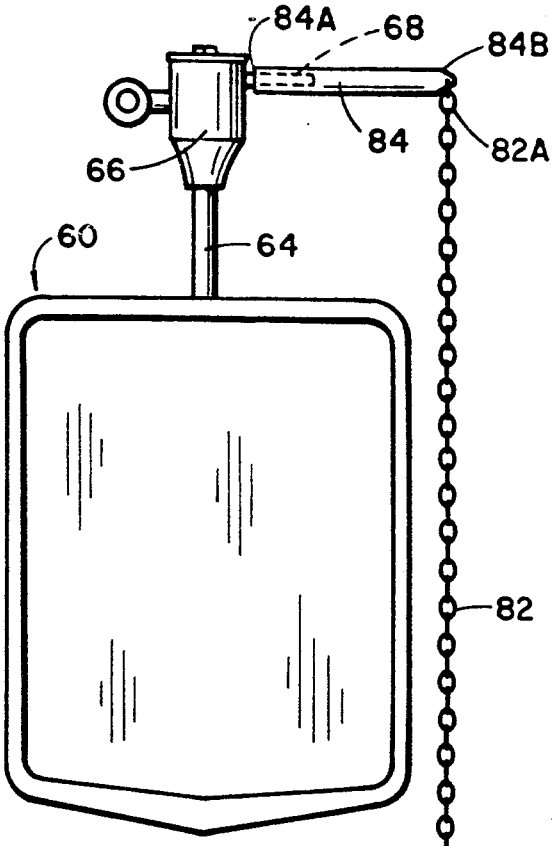
FIG. 5 is a front elevational view of a wall mounted urinal and showing an adapter for converting the urinal to foot flushing.

FIG. 5 shows a means of converting a typical wall mounted urinal for foot actuation. A wall mounted urinal, generally indicated by the numeral 60, is supported above a floor 62, usually on a wall, the wall not being shown. The typical wall mounted urinal 60 has a pipe 64 extending upwardly therefrom and connected to a flush valve 66. Pivotally extending from the flush valve is a flush lever 68. To flush the urinal, lever 68 is manually pivotally displaced relative to valve 66. The valve is designed to permit a preselected quantity of water to pass therethrough to produce flushing action of the urinal 60 each time the flush lever 68 is pivotally displaced. The flush lever is so positioned that it can only be actuated manually.

The adapter for converting the wall mounted urinal of FIG. 5 for foot operation includes a vertical post 70 extending upwardly from floor 62. Post 70 may be secured to a base plate 72 which is, in turn, fastened to the floor surface 62, however, the use of a base plate 72 is optional since the post 70 may be directly secured within an opening drilled in floor surface 62.

Slidably received upon post 70 is a foot actuator 74. The actuator includes a tubular portion 76 having an opening 78 therein communicates with the foot actuator bottom surface 74B. Post 70 is received within opening 78.

Integrally formed with the foot actuator tubular portion 76 is an increased external diameter flange 80.

Affixed to the upper end 74A of the foot actuator is the lower end 82B of a chain 82. The upper end 82A of the chain is affixed to the flush lever 68. Thus, when the foot actuator 74 is downwardly displaced, such as by the user stepping on the flange portion 80, the chain 82 is downwardly displaced, pivoting the flush lever 68 to flush urinal 60.

It may be necessary, or at least desirable, to provide an extender 84 which is coaxially affixed to the flush lever 68. The extender may be affixed to the lever in several ways. In one way, the extender may have a recess in the inner end 84A so that the extender is merely telescopically slipped onto the flush lever 68 with a resistance fitting which does not permit easy removal of the extender from the lever. The outer end 84B of the extender is then affixed to the upper end 82A of the chain.

Figure 6:
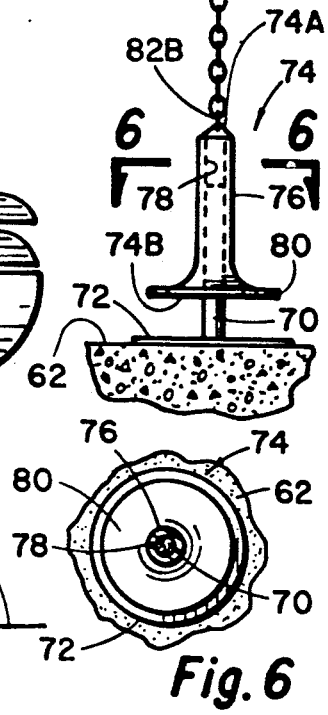
FIG. 6 is a horizontal cross-sectional view of major portions of the foot adapter for a wall mounted urinal taken along the line of 6—6 of FIG. 5.

While not shown in FIGS. 5 and 6, the use of a compression spring between the upper end of post 70 and the interior upper end of the opening 78 in the foot adapter 74 can be employed so that the foot adapter automatically returns to its selected upward position when the foot pressure is released to thereby more easily permit the flush lever 68 to return to its normal position after a flushing action.

Figure 9:
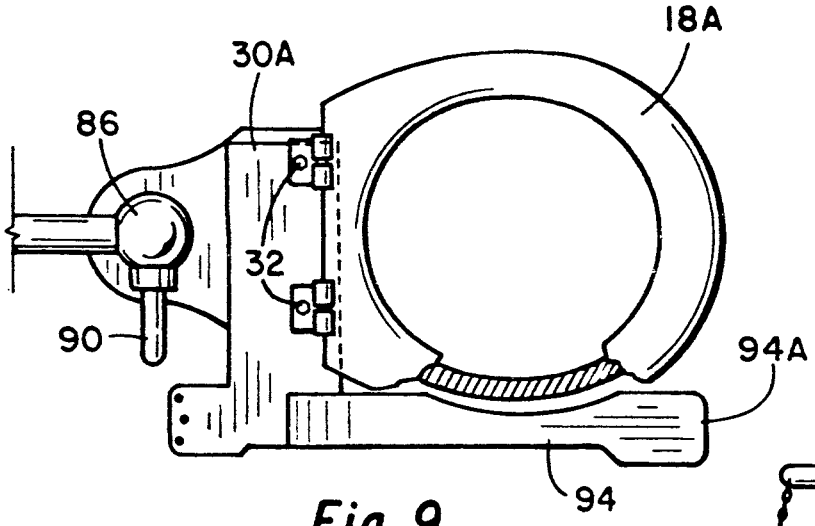
FIG. 9 is a top plan view of a typical stool in commercial establishments which uses a flush valve rather than a water closet and showing an alternate foot flush adapter.
Figure 7:
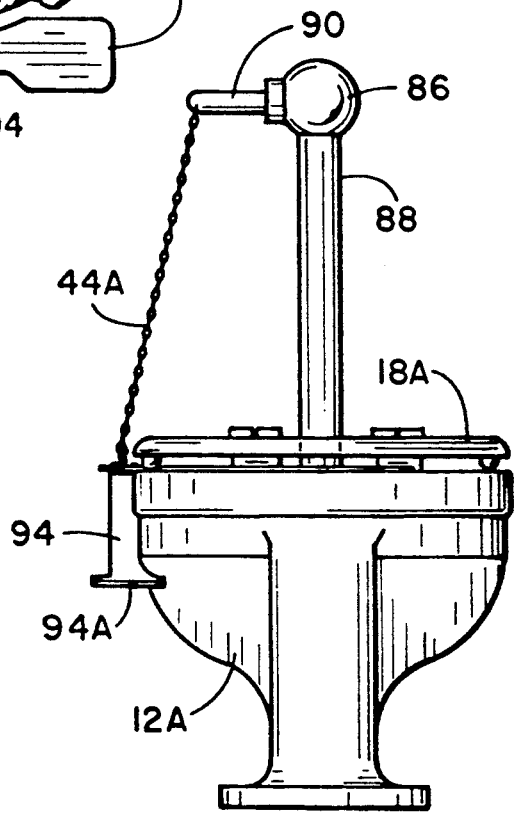
FIG. 7 is a front elevational view of a toilet, such as shown in FIG. 1, which uses a flush valve instead of a water closet and which has an alternate type of foot flush adapter.
Figure 8:
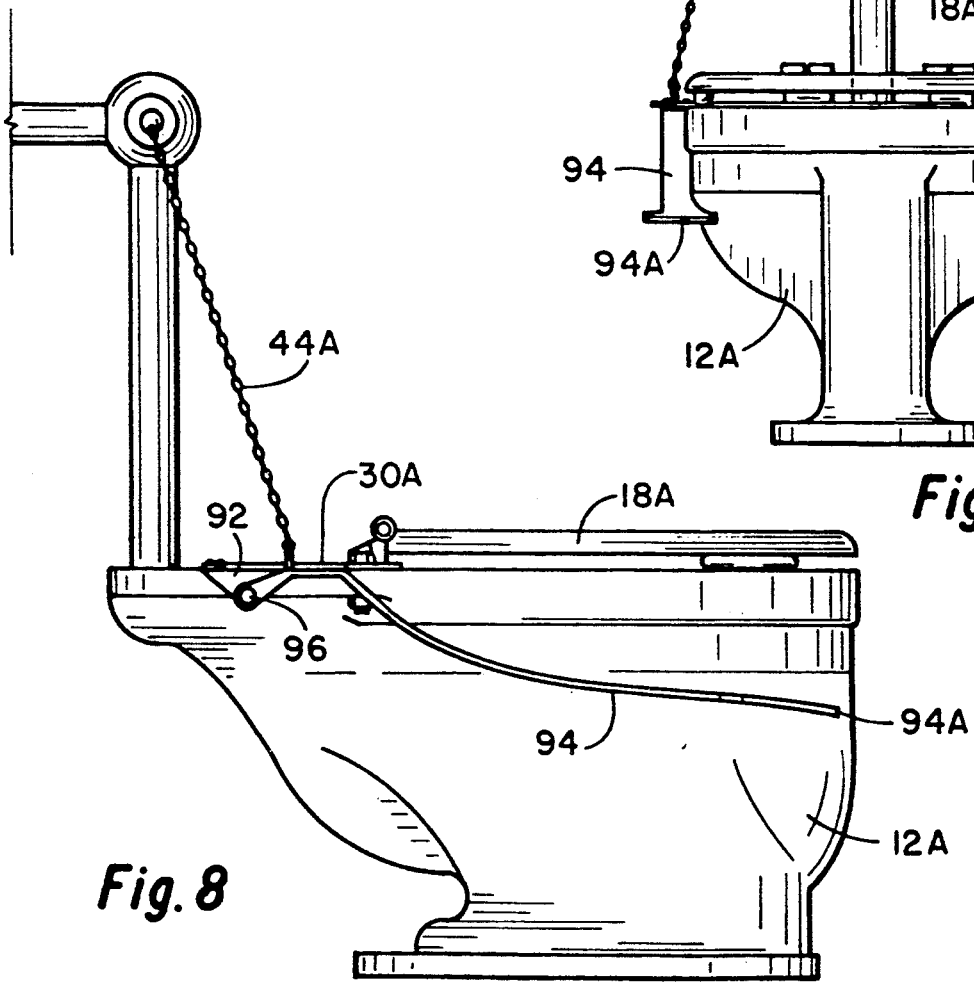
FIG. 8 is an elevational side view of the embodiment of the invention shown in FIG. 7.

Referring to FIGS. 7, 8 and 9, an alternate arrangement for the foot flush adapter of a stool is shown. These figures show a stool of the type commonly employed in commercial and public facilities which uses a flush valve 86 instead of a water closet as shown in FIGS. 1–3. The flush valve connects to the stool 12A by means of a pipe 88, and the flush valve has a flush lever 90 extending from it. The stool 12A has an adapter plate 30A similar to the adapter plate 30 previously described with reference to FIGS. 1–3. In this embodiment, the adapter plate has a hinge portion 92 with a foot lever 94 pivoted thereto. The foot lever is elongated and extends generally horizontally and has an outer end 94A that is adjacent the front of the stool 12A. One end of chain 44A is attached to the foot lever adjacent a hinge pin 96 by which the foot lever is pivoted to the hinge portion 92 of plate 30A. The other end of chain 44A is attached to the outer end of flush lever 90. Flush lever 90 is therefore easily pivoted downward to the flush position by downward push by the user's foot on the foot lever 94.

The embodiment of the invention as shown in FIGS. 7, 8 and 9 can be use with a stool having a water closet of the type shown in FIGS. 1, 2 and 3 with chain 48 being connected to a flushing lever, such as lever 26 in FIG. 1.

FIGS. 7 and 8 show chain 44 attached directly to the outer end of flush lever 90. In many applications the use of an extender such as element 84 in FIG. 5 or element 84A in FIG. 10 will be desirable in the installation shown in FIGS. 7 and 8.

Figure 10:
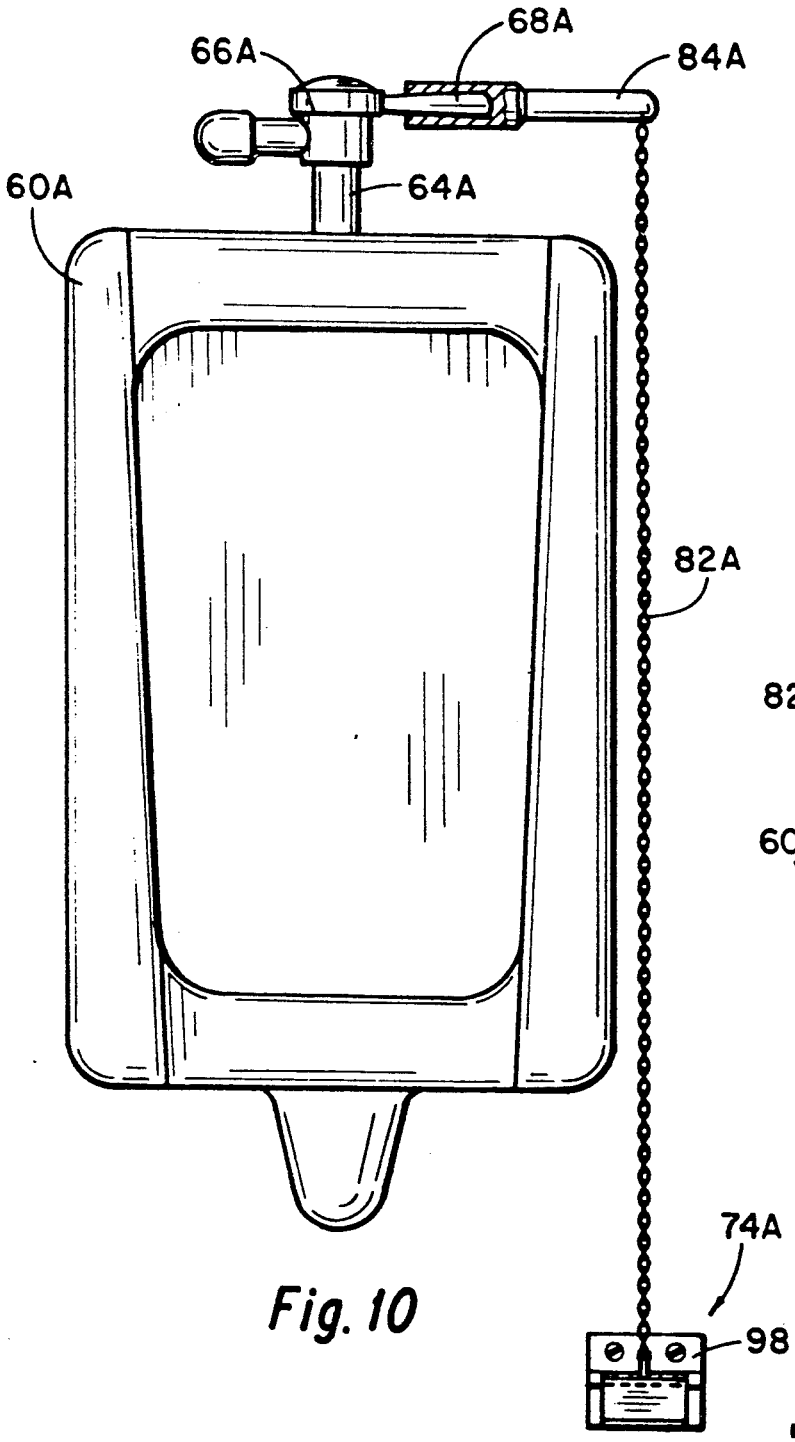
FIG. 10 is a front elevational view of a wall mounted urinal, showing an alternate configuration of the adapter for converting the urinal to foot flushing.
Figure 11:
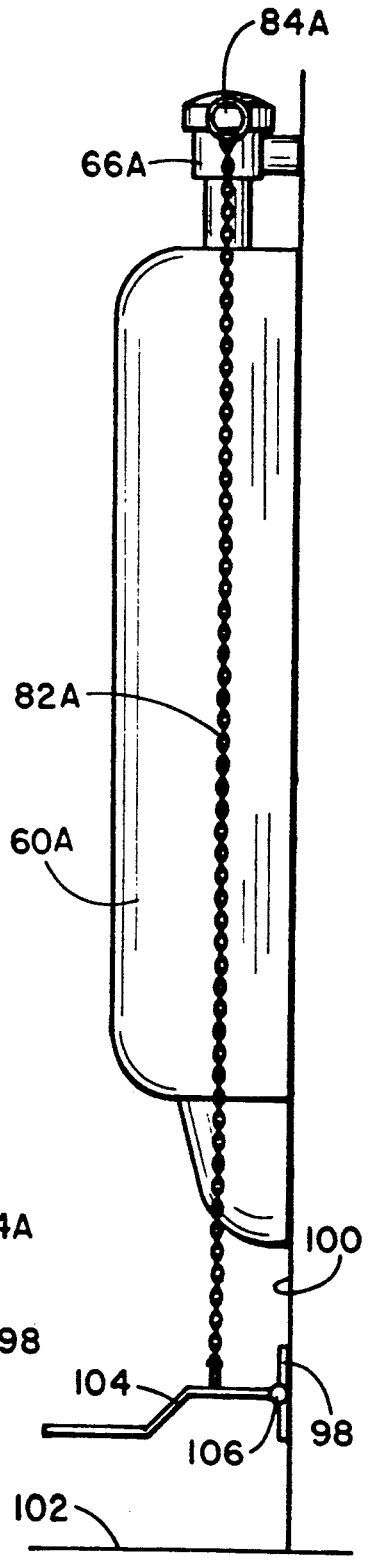
FIG. 11 is an elevational side view of the urinal of FIG. 10, showing the alternate foot flush adapter.

FIGS. 10 and 11 show an alternate embodiment for a wall mounted urinal. The urinal 60A has a flush valve 66A and flush lever 68A with a conduit 64A connecting the flush valve to the urinal, all as described with reference to the wall mounted urinal of FIG. 5. A chain 82A is attached to the outer end of the flush lever 84A.

A plate 98 is affixed to wall 100 on which the urinal 60A is mounted. The plate 98 is affixed to the wall 100 a short spacing above the floor 102, the foot lever being pivoted to the plate about hinge 106. One end of the chain 82A is attached to the outer end of flush lever extender 84A and the other end is attached to foot lever 104. The user can flush the urinal by putting his foot on the horizontally extending foot flush lever 104 to thereby pivot the flush lever 68A.

Thus, it can be seen that the alternate arrangements of FIGS. 7–11 provide for pivot mounted foot levers for flushing either a stool or wall mounted urinal. The use of foot levers have advantages, in some instances, over the actuators of FIGS. 1–7, although the result is the same, that is, in either case, the user can flush either a stool or a wall mounted urinal without engaging his hands with any portion of these pieces of equipment.

The disclosure herein thus provides inexpensive and easily adaptable mechanisms for use with standard commonly existing toilets and wall mounted urinals to adapt them for foot flushing action and to thereby relieve the manual flushing requirement which is distasteful to many people while, at the same time, permitting manual flushing in the customary way.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. For use with a toilet having a toilet bowl with a generally horizontal upper surface on which a toilet seat is attached by bolts and a water closet connected to the toilet bowl having at least one generally vertical sidewall, the water closet having a flush valve actuator with a generally horizontal flush shaft extending through the vertical wall and a flush lever affixed to the flush shaft, the lever extending generally horizontally and parallel to and spaced from the wall and having an outer end, the toilet normally being flushed by the rotation of the lever by manual engagement with the lever, a foot flush adapter which permits flushing of the toilet without hand contact with the lever comprising:

an adapter plate supported to the toilet bowl horizontal upper surface by said bolts and extending from said surface, the adapter plate having a U-slot therein;

a tubular support member affixed to and received in said U-slot in said adapter plate by cooperation of a circumferential groove with said U-slot, said support member being generally vertically supported by said U-slot;

a rod slidably received in and vertically reciprocally supported in said tubular support member, the rod having an upper and a lower end;

said upper end of said rod being connected to the outer end of said flush lever; and a generally horizontal foot member affixed to said rod at said lower end thereof, the foot lever being thereby supported adjacent the toilet bowl whereby downward displacement of said foot lever displaces said rod with respect to said support member, thereby causes the flush lever, to rotate the flush shaft to flush the toilet.

2. A foot flush adapter for a toilet according to claim 1 including:

spring means interposed between said tubular support member and said rod to normally resiliently bias said rod in the upward direction.

3. A foot flush adapter for a toilet according to claim 2 wherein said tubular support member has a portion of the tubular opening therethrough of enlarged internal diameter compared to the diameter of said rod, and including:

a collar affixed to said rod within said support member enlarged internal diameter portion;

a helical compression spring received by said rod and within said tubular support member enlarged internal diameter portion, the spring having an upper end in contact with said collar and a lower end; and a closure member having an opening therethrough slidably receiving said rod and removably affixed to said tubular support member, said lower end of said spring contacting the closure member whereby when said foot lever is downwardly depressed, said spring is compressed.

* * * * *